US005255834A

United States Patent [19]

Bendersky

[11] Patent Number: 5,255,834

[45] Date of Patent: Oct. 26, 1993

[54] ARTICLE CARRIERS WITH INCORPORATED THREE-DIMENSIONAL GRAPHICAL DISPLAY PANELS

[75] Inventor: Edward S. Bendersky, Lake Forest, Ill.

[73] Assignee: ERO Industries, Mt. Prospect, Ill.

[21] Appl. No.: 807,170

[22] Filed: Dec. 13, 1991

[51] Int. Cl.[5] ..... A45F 3/04

[52] U.S. Cl. ..... 224/209; 224/215; 224/907; 206/457; D3/32; D3/45; D3/46; 446/72; 446/73

[58] Field of Search ..... 224/209, 215, 907; 206/457, 523; 446/73, 72; D3/32, 45, 46; 5/907, 929

[56] References Cited

U.S. PATENT DOCUMENTS

| | | | |
|---|---|---|---|
| D. 79,418 | 9/1929 | Cohen | D3/46 |
| D. 151,750 | 11/1948 | Feigl | D3/46 |
| 1,852,964 | 4/1932 | George . | |
| 2,356,225 | 8/1944 | Cunnington | 154/2 |
| 2,752,279 | 6/1956 | Alderfer | 154/100 |
| 3,679,108 | 7/1972 | Ingram | 224/8 R |
| 3,843,980 | 10/1974 | Rodriguez | 5/929 X |
| 4,098,447 | 5/1978 | Achmeteli | 224/25 A |
| 4,174,059 | 11/1979 | Maunder | 224/209 |
| 4,420,103 | 12/1983 | Douglass | 224/210 |
| 4,662,550 | 5/1987 | O'Donnell | 224/209 |
| 4,830,245 | 5/1989 | Arakaki | 224/210 |
| 4,941,603 | 7/1990 | Creamer et al. | 224/148 |

OTHER PUBLICATIONS

Lillian Vernon Catalog, Jul. 26, 1990, p. 57.

*Primary Examiner*—Gary E. Elkins
*Assistant Examiner*—Paul A. Schwarz
*Attorney, Agent, or Firm*—Lockwood Alex Fitzgibbon & Cummings

[57] ABSTRACT

New and improved article carriers are provided in carrier bodies including an integral shaped thermoplastic molded three-dimensional graphical display panel to provide distinctive physical appearance and shock-absorbing protective characteristics in use. In accordance with the preferred embodiment, new and improved book bag backpack carriers are provided having the outwardly f acing rear panel and bottom panel formed from the shaped three-dimensional graphical display panels.

5 Claims, 2 Drawing Sheets

ARTICLE CARRIERS WITH INCORPORATED THREE-DIMENSIONAL GRAPHICAL DISPLAY PANELS

BACKGROUND OF THE INVENTION

The present invention generally relates to light weight article carriers frequently used, for example, as book bags by school children for carrying papers and notes between the teacher and/or school and the parents, books, gym clothes and shoes, and a packed lunch to and from school each day. More particularly, it relates to a new and improved backpack, book bag or other carrier having at least one molded, protective, three-dimensional character panel incorporated therein and positioned on the carrier and constructed so as to provide the combined advantages of a desired distinctive physical appearance and shock absorbing protection for the articles placed in the carriers in use.

Backpack-style book bags have increased in popularity in recent years as a convenient method for younger school children to carry a snack and their lunch, their gym shoes and various papers and books as necessary each day. More often than not, a backpack book carrier is now listed as a required back-to-school supply item in most school districts. As a result the number of styles, sizes, colors and shapes of backpack book bags for the back-to-school market has increased dramatically in the last few years. The market size is easily over 10 million dollars each year for these products. Competition between manufacturers for increased market share is especially intense. Manufacturers frequently rely heavily on distinctive visual images or copyrighted character licenses to help them gain a competitive edge for their annual backpack and other carrier offerings. Usually the licensed copyrighted characters are more important from the marketing standpoint than the actual construction or materials from which the carriers are made.

In the past, copyrighted licensed characters such as for example super heroes from comic strips such as Superman ® or Batman ®, Cabbage Patch Kids ®, or television and movie personalities such as for example the Teenage Mutant Ninja Turtles ® have been employed in the marketing of back-to-school backpack and other carriers by applying visual graphic images of these characters onto surface panels of the carriers through silk screening, sewn fabric patches, or other methods of application. The planar or two-dimensional presentation of the licensed characters has now become so commonplace that two-dimensional images are not sufficiently distinctive for some marketing objectives.

Accordingly, three-dimensional character depictions to enhance marketing appeal for the backpack or book bag carrier products are now available. More particularly, promotion of certain tote bags and backpack carriers has been attempted by providing carriers having small three-dimensional Cabbage Patch Kids ® licensed characters thereon. In order to promote the Cabbage Patch Kids ® motif and these carrier bag products, the characteristic head and hair portion of the Cabbage Patch Kids ® dolls was fashioned into a three-dimensional sculpture and physically applied to an outer facing surface of backpacks and tote bags. Typically, the projecting doll face and hair was affixed to the surface of the carrier bag by the use of adhesives or mechanical fasteners. The three-dimensional presentation of the doll's face projecting from the side surface of the carriers is a successful marketing approach to promoting carrier bags with licensed characters.

A major shortcoming of these bags with add-on three-dimensional characters is that the doll face mounted onto the bag projects outwardly in a manner which permits it to become tangled or dislodged in use. This is primarily due to applying the smaller doll face onto the larger bag surface providing a defined edge to the add-on character which enables it to become easily separated from the carrier either by mischievous hands or in the wear and tear of daily use.

In use, back-to-school backpack carriers often receive rough handling and treatment. They are repeatedly slung over the shoulder of school children and mashed against seat of the school bus or thrown against the side wall of the bus as a child sits in the bus seat. Frequently, they are thrown into school closets or on the floor as the child enters the home. Often the book bag carriers may be used as weapons to hit other school children or other items along the way in a pillow-fight fashion, by being swung by the handles or a hanger loop provided to hang the bag on a hook. The prior art three-dimensional doll face add-on structures are too easily dislodged or may cause pain and possible injury.

Backpacks including a cushioning inner back panel in the carrier body are generally known. The cushioning panels are typically placed on the inward facing back support surface of the carrier. For example, inserts for improving the comfort of a backpack carrier are described in U.S. Pat. No. 3,679,108 to Ingram and in U.S. Pat. No. 4,089,447 to Achmeteli. The use of integrated or attachable rear foam panels is also shown in U.S. Pat. No. 4,420,103 to Douglass and in Arakaki, U.S. Pat. No. 4,830,245. The use of a doll or character three-dimensional structure as the inward facing panel of a backpack carrier is described in U.S. Pat. No. 4,662,550 to O'Donnell. Each of the above-mentioned patents are primarily directed to providing a more comfortable backpack carrier by providing a softer inward facing panel. Little or no provision is made to protect the contents of the carrier from impact in use.

Accordingly, in order to overcome the shortcomings of the prior art carriers, it is an object of the present invention to provide a new and improved carrier including an integral or incorporated three-dimensional graphical display panel to provide a distinctive visual appearance for the outwardly facing panels of the carrier.

It is another object of the present invention to provide a three-dimensional graphical display panel forming an integral part of the construction of the carrier which will not become detached or disconnected from the body of the carrier in use.

It is another object of the present invention to provide a new and improved book bag backpack carrier having a panel structure including impact resistant panels positioned in the carrier along points most likely to be impacted in use.

It is another object of the present invention to provide a new and improved book bag backpack carrier incorporating a three-dimensional licensed character panel which simultaneously provides impact protection for the contents of the backpack in the normal course of wearing and use by a small school child.

SUMMARY OF THE INVENTION

In accordance with these and other objects, the present invention provides a new and improved carrier for articles comprising a hollow carrier body defined by a plurality of interconnected body panels including a bottom panel adapted to be maintained generally parallel to a ground surface in use and at least one generally upstanding panel extending from said bottom panel having an outwardly facing major surface, said carrier body having an access opening and handle means to permit the carrier to be hand-carried in use, said upstanding panel including a molded layer providing an outwardly projecting, raised three-dimensional character structure defined in said outwardly facing surface. The new and improved carriers in accordance with this invention are characterized by a distinctive integrated, sculptured surface appearance and a mild shock-absorbing body construction.

In accordance with a preferred embodiment, the present invention provides a new and improved soft walled backpack book bag carrier comprising a hollow carrier body defined by a pair of generally upstanding parallel panels including an inwardly facing panel adapted to lie adjacent a wearer's back and an opposing, spaced apart outwardly facing rear panel, a bottom panel and an opposing top panel extending generally perpendicular to and interconnecting said upstanding inwardly facing and outwardly facing panels and a pair of opposing side edge panel extending between and interconnecting the remainder of the periphery of said upstanding panels to define a hollow carrier body having an inner body cavity for receiving items to be carried, said carrier body including a reclosable access opening to said body cavity having a releasable fastener means, said carrier further including a pair of backpack shoulder straps affixed to said carrier body to lie adjacent said inwardly facing panel; and said outwardly facing rear panel including an integral three-dimensional graphical display or character portion of a shock absorbing, moldable thermoplastic material substantially co-extensive with said rear panel and effective to provide cushioning protection to items placed in the carrier body cavity in use.

In accordance with a preferred embodiment, the new and improved book bag backpack carrier of the invention will include an integral unitary three-dimensional character or graphical display portion provided by a shaped three-dimensional panel formed of a non-brittle resilient thermoplastic material such as a moldable polyolefin, e.g., polyethylene, polypropylene, polyvinyl chloride, polyesters and polyurethane thermoplastic molding compositions. Preferably, the three-dimensional display panel comprises a fabric covered molded intermediate thermoplastic foam sheet layer. In accordance with this preferred embodiment, a nylon/-polyethylene knitted fabric covering for an ethylene vinyl acetate foam layer is vacuum form, compression molded to provide a three-dimensional character or graphical display image to the foam panel prior to its being incorporated preferably directly into the backpack carrier body. Typically, the foam panel including the three-dimensional character image molded therein will have a resilient foam construction having sufficient thickness to provide some cushioning protection from impact in normal use. In the case of a soft ethylene vinyl acetate foam, a foam sheet thickness prior to molding of between one fourth inch to two inches thick, especially preferably one-half inch to one inch thick, is provided.

As has been mentioned above, in accordance with the present invention the three-dimensional outward facing graphical display panel is advantageously formed in a vacuum form molding operation. A protective knitted fabric outer layer over each surface of the foam layer provides an integral unitary panel member which may be directly sewn or otherwise secured to the other backpack panels defining the book bag or other carrier so that the three-dimensional display or character image will generally not be destroyed or removed from the backpack in use. Although an integral, unitary construction is especially preferred herein, a resilient, shock absorbing three dimensional panel substantially co-extensive with an outward facing carrier fabric panel may be provided and secured to the outwardly facing rear carrier panel to provide the three-dimensional character image and impact resistance in accordance with the present invention.

In accordance with especially preferred embodiments, an impact resistant foam graphical display panel will be provided as the outwardly facing rear panel and the bottom panel to the backpack carrier to provide an impact resistant panel along those locations of the backpack most likely to be subjected to impacts and collisions in ordinary use. Especially preferably, the rearward facing panel and the bottom panel may be molded as a common one-piece unit with appropriate fold lines being placed therein. The fabric coated foam moldings provide a tear resistant three-dimensional foam image capable of providing truly distinctive visual characteristics to the backpack carriers. Additional auxiliary side pockets may be positioned along the side edge panels as desired. Additional hanger hook straps or handles may also be affixed to the body of the carrier in addition to the backpack carrier straps.

Other objects and advantages of the present invention will become apparent from the following Detailed Description of the invention taken in conjunction with the Drawings in which:

DETAILED DESCRIPTION OF THE PREFERRED EMBODIMENTS

Figure 1:
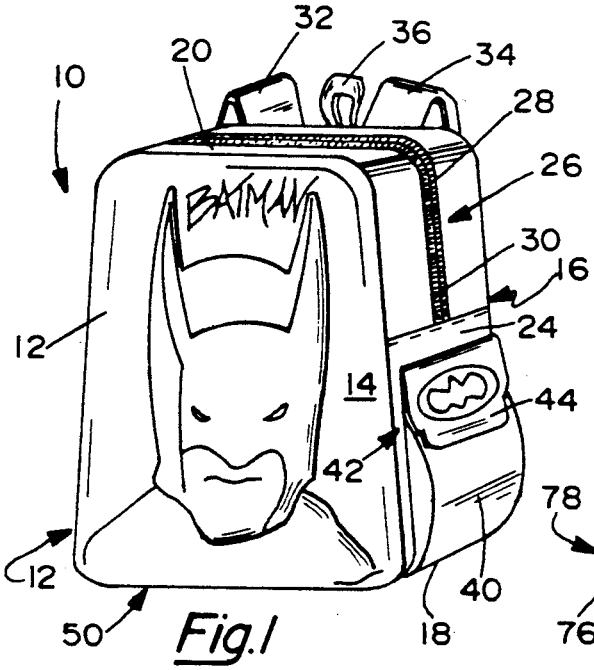
FIG. 1 is a perspective view of the new and improved book bag backpack carrier of the present invention.

Referring now to FIG. 1, the preferred new and improved soft walled carrier in the form of a book bag backpack carrier 10 is shown. Backpack carrier 10 includes a hollow carrier body 12 defined by a plurality of panels including an upstanding, outwardly rearwardly-facing three-dimensional graphical display panel 14, an inwardly facing, generally spaced and opposed, parallel upstanding back panel 16, a bottom panel 18, and opposing top panel 20 and a pair of opposing left and right side panels 22 and 24, respectively. Carrier 10 includes an inner body cavity or interior space 26 adapted for receiving items to be carried through top access opening 28 provided generally along the central portion of top panel 20. Top access opening 28 is a reclosable opening provided with a releasable zipper or slide fastener 30 to open and close the entrance to opening 28 the body cavity 26. As shown in the preferred embodiment depicted in the drawings, backpack carrier 10 is preferably provided with left and right, padded, angled backpack shoulder support straps 32 and 34. A hanger hook loop strap 36 is also affixed to the upper portion of inwardly facing back support panel 16. Also in accordance with the preferred embodiment, carrier 10 is preferably provided with left and right hand side gusset pockets 38 and 40 affixed onto the left side panel 22 and right side panel 24, respectively. Gusset pockets 38 and 40 are each provided with a top entry opening 42 having a reclosable top flap 44. Top flaps 44 may be releasably secured in a closed position by means of cooperating hook and loop fastener strips 46 and 48 on the inside of top flap 44 and the top outer surface of each gusset pocket 38 and 40.

Figure 7:
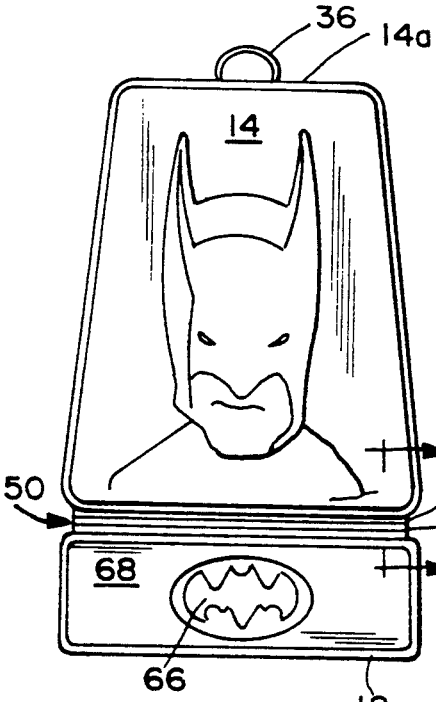
FIG. 7 is a front elevation view of the three-dimensional character rear panel and bottom panels in accordance with the preferred embodiment.
Figure 8:
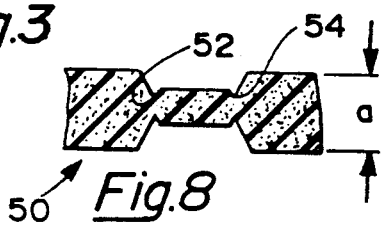
FIG. 8 is an elevated cross-sectional view of the living hinge section molded in to the one-piece rear and bottom three-dimensional molded panels in accordance with the preferred embodiment, taken along view lines 8—8 in FIG. 7.

In accordance with this invention, backpack carrier 10 is provided with an integral, unitary rearwardly-facing three-dimensional graphical display panel 14. More particularly, in the especially preferred embodiment depicted in FIGS. 1-8, rearward facing panel 14 and bottom panel 18 are preferably formed of a single piece of impact-protective or shock-absorbing fabric covered three-dimensional molded thermoplastic foam sheet stock joined together along a living hinge section 50. Living hinge 50 includes a pair of parallel spaced apart lines 52 and 54 of relatively thinner cross-sectional thickness, best shown in FIGS. 7 and 8, to define dedicated fold lines at 52 and 54.

The three-dimensional molded graphical display panels 14 and 18 preferably include a vacuum form-compression molded interior layer 56 of moldable thermoplastic foam sheet stock. The foam sheet stock should be pliable or flexible, resilient and deformable and have a cross-sectional thickness dimension, a, sufficient to provide at least some shock absorbing protection from normal impacts expected under conditions of normal use. Especially preferred foam sheet layers are ethylene vinyl acetate foam sheet stocks having a thickness dimension of from about ¼ inch to about 2 inches in gauge or thickness. Preferably, foam layer 56 will have a flexible expandable knitted fabric material adhered to its opposing major surfaces 58 and 60. A knitted fabric of nylon and polyethylene is especially preferred as the abrasion and tear resistant inner and outer surface covering layers 62 and 64. The outer fabric covering layers are preferably affixed to the adjacent foam layer surfaces 58 and 60 by means of a suitable surface to surface curable or contact adhesive prior to processing in conventional vacuum forming and compression molding operation. The three-dimensional high relief image of a character which is the partial bust of Batman, as shown, provides an upstanding shock absorbing panel. Although a soft foam thermoplastic shaped panel is preferred, a three-dimensional panel made from a shaped three-dimensional resilient thermoplastic panel, either molded sheet or simply molded, may also be used.

Figure 2:
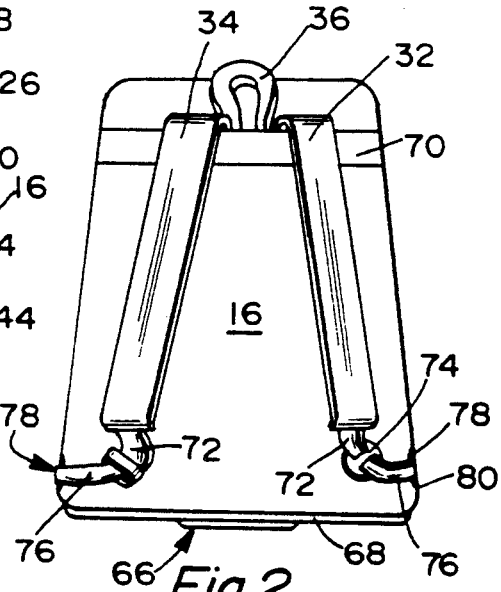
FIG. 2 is a rear elevation view of the new and improved book bag backpack carrier of the present invention.
Figure 3:
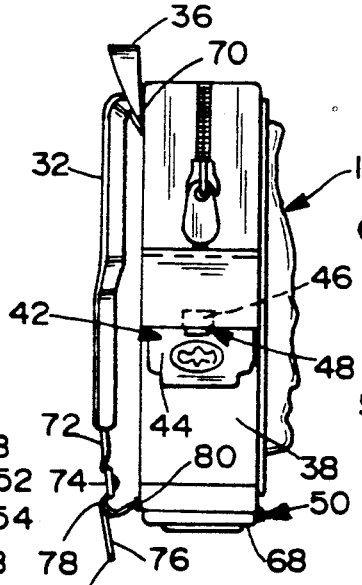
FIG. 3 is a side elevation view of the new and improved book bag backpack carrier of the present invention.
Figure 4:
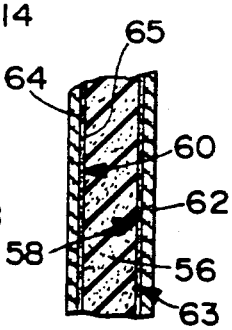
FIG. 4 is an elevated cross-sectional fragmentary view showing the side wall construction of the preferred graphical display panel in accordance with the present invention.
Figure 5:
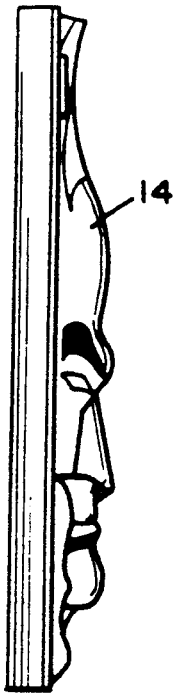
FIG. 5 is a side elevation view of the new and improved three-dimensional graphical display panel for use with the book bag backpack carriers of the present invention.
Figure 6:
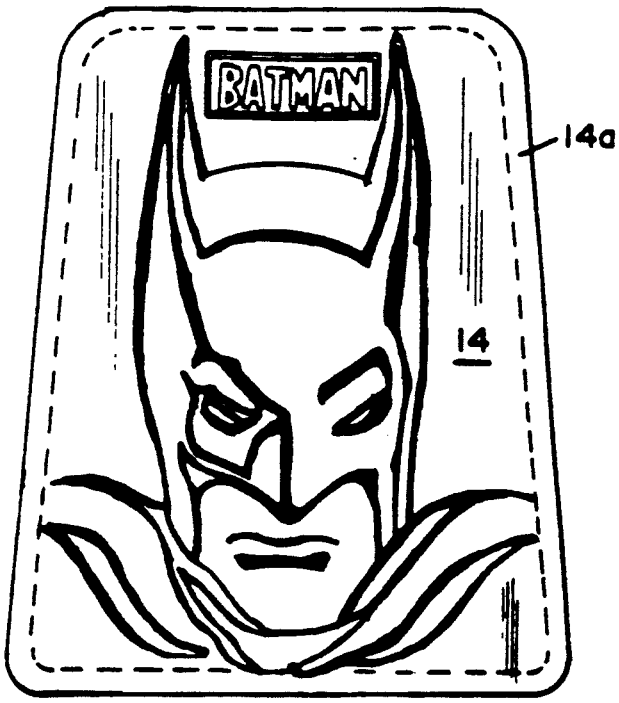
FIG. 6 is a front elevation view of the three-dimensional graphical display panel shown in FIG. 5.

As shown in the side views in FIGS. 3 and 5, the forehead and nose portions of the Batman character project out of the plane of the panel 14 to a significant degree of on the order of from 0.5 inch to about 2.0 inches, preferably about 1.0 inch to contribute a shock absorbing feature as well as a visually distinctive appearance. The peripheral edge portions **14*a* and 18*a* of rearward character panel 14 and bottom panel 18, respectively, have a thin cross sectional thickness dimension to facilitate the direct incorporation or assembly of the panels 14 or 18 to the edge portion of the other adjacent panels by stitching sewn seams or by other suitable attaching means to form up or assemble the carrier body 12. The raised bat-in-the-oval symbol or logo 66 for Batman is provided on the bottom panel 18 to define a raised padded, variegated or irregular bottom surf ace 68 best shown in FIGS. 2-4 to further provide a shock-absorbing impact protective bottom panel for the contents of interior cavity 26. Placement of the shock absorbing foam panels at the rearward facing panel 14 and the bottom panel 18** provide the shock absorbing features where potentially damaging impact is most likely to occur.

The knitted fabric cover layers 62 and 64 not only assist in maintaining the effective character shape and integrity of the molded foam layer 56, by reducing abrasion or tearing of the foam, they also permit the foam panels to be provided in a full spectrum of colors from a universal molded foam interlayer 56. The fabric cover layers 62 and 64 should be knitted so that they may be locally stretched and expanded in the molding operation without rupturing or tearing. The fabric surface layers 62 and 64 are adhesively bonded to intermediate foam layer 56, preferably by flexible, stretchable adhesive layers 63 and 65 which when cured remain firmly adherent to the adjacent structures. Rubber-like adhesives, such as a Neoprene-based adhesive are preferred, although other adhesives or other fabric securement methods might also be used.

In accordance with the present invention, the three-dimensional molded graphical display panels, such as panels 14 and 18 of carrier 10, themselves form an integrated assembled panel of the overall carrier structure. The visual marketing appeal function of the three-dimensional character or other image is built-in to the carrier so that preferably, the image cannot be accidentally removed from the carrier in use. This provides a distinct advantage over prior art three-dimensional add-ons such as a Cabbage Patch Kids® doll face which may be pried off or removed from the carrier either accidentally or intentionally.

In accordance with this invention, the carrier body is assembled by stitching the edge portions, e.g. **14*a* and 18*a*, of adjacent panels together to form edge seams. A webbing strip 70 on back panel 16, shown in FIG. 2, may be applied by stitching in accordance with conventional methods to permit appropriate placement and securement for the backpack shoulder straps 32 and 34 to back panel 16**. Preferably, the shoulder straps include an adjustment strap and buckle arrangement as shown in FIGS. 2–3, including a strap extension 72 and adjustment buckle 74 extending from the lower end of shoulder straps 32 and 34 and an adjustment strap 76 having one end 78 sewn in a vertical orientation into vertical side seams at 80 as shown. The opposing free end 82 of adjustment strap 76 is adjustably threaded through buckle 74. Other strap adjustment hardware may also be used.

The top portion of shoulder straps 32 and 34 lie in a plane parallel to back panel 16 and the respective lower adjustable ends 76 of the straps are affixed to the side seams 80 in a plane generally normal or perpendicular to the plane of back panel 16 to provide a more comfortable, non-interfering looping shoulder strap for the wearer.

Other patches, writing, figures, symbols or other indicia, may be sewn or silk screened or otherwise applied or printed on the outer surface of the carrier, if desired.

Figure 9:
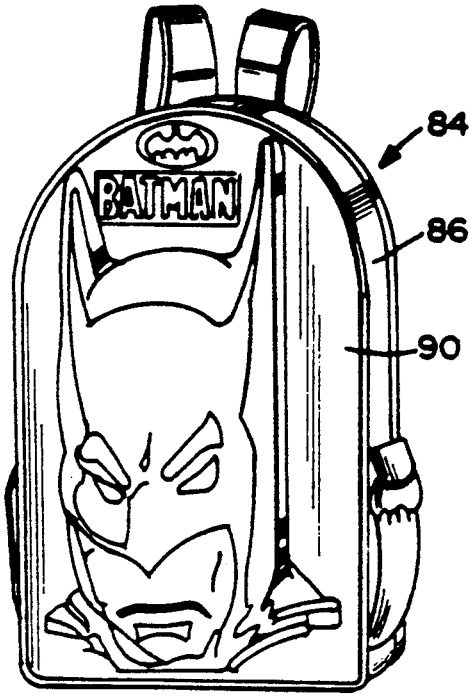
FIG. 9 is a perspective view of an alternate book bag carrier in accordance with the present invention.
Figure 10:
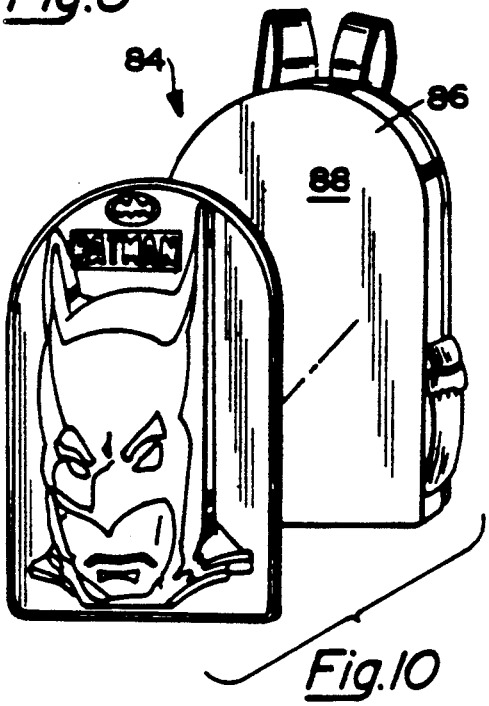
FIG. 10 is an exploded perspective view of the alternate book bag backpack carrier shown in FIG. 9.

Referring now to FIGS. 9 and 10 an alternate embodiment of the backpack carrier generally referred to by reference numeral 84 is shown. Alternate carrier 84 also includes a backpack carrier body 85 formed from a plurality of edge seamed fabric panels including a rearwardly facing fabric panel 88. In accordance with this alternate embodiment, a three-dimensionally molded character panel 90 having a molded high relief Batman character face projecting from one side thereof is adhesively bonded or otherwise permanently secured to panel 88. The molded character panel 90 is dimensioned and configured so that it is substantially co-extensive with rear panel 88 and completely covers the entire surface of panel 88 in its assembled condition shown in FIG. 9. This alternate embodiment provides a different method for achieving the desired integrated three-dimensional molded character visual effect and impact resistant properties to carrier 84. The molded panel 90 is preferably co-extensive with panel 88 to provide a more complete attachment of the molded panel 90 to carrier body 86 and to avoid the discrete smaller add-on look and feel of the prior art 3-D character bags which are more easily pried off.

Although the present invention has been described with reference to certain preferred embodiments, modifications or changes may be made therein by those skilled in this art. For example, although it is preferred to provide at least one molded three-dimensional graphical display panel with a knitted fabric covering on both sides thereof, a molded foam panel having a fabric layer on only one side thereof or not having any outer fabric layer may also be used. Alternatively, in place of a molded foam panel, the three dimensional graphical display panel may also be made of a molded resilient thermoplastic resin or sheet material. Instead of the three dimensional graphical display panel including a three dimensional image of a popular licensed character, other three-dimensional images of mountains or other natural phenomena, for example, may also be employed. Furthermore, instead of providing the integral, unitary incorporated three-dimensional graphical display panel on a backpack carrier, the shock absorbing graphical display panel may also be used as the appropriate outward facing panel of alternative carrier bodies, such as for example in tote bags, sport bags or gym bags, in luggage, wallets and even for ski vests. All such obvious modifications or changes may be made herein without departing from the scope and spirit of the present invention as defined by the appended claims.

I claim:

1. A soft walled book bag backpack carrier comprising a hollow carrier body defined by a pair of generally upstanding parallel panels including an inwardly facing panel adapted to lie adjacent a wearer's back and an opposing, spaced apart outwardly facing rear panel, a bottom panel and an opposing top panel extending generally perpendicular to and interconnecting said upstanding inwardly facing and outwardly facing panels and a pair of opposing side edge panels extending between and interconnecting said upstanding panels to define a hollow carrier body having an inner body cavity for receiving items to be carried, said carrier body including a reclosable access opening to said body cavity having a releasable fastener means, said carrier further including a pair of backpack shoulder straps affixed to said carrier body to lie adjacent said inwardly facing panel, said outwardly facing panel of said carrier body being a unitary, shock-absorbing, resilient flexible shaped thermoplastic molded foam member having an outwardly projecting three-dimensional graphical display shaped configuration portion and a peripheral edge portion, said outwardly facing rear panel being directly attached to said top, bottom and each of said side edge panels along said peripheral edge portion.

2. A soft walled book bag backpack carrier as defined in claim 11, wherein said rear panel is directly attached to each of said top, bottom and side panels by stitching to form a sewn seams therebetween.

3. A carrier for articles comprising a generally hollow carrier body defined by a plurality of interconnected body panels including a bottom panel adapted to be maintained generally parallel to a ground surface in use and at least one generally upstanding panel having an outwardly facing major surface extending upwardly from an edge of said bottom panel, said carrier body having an access opening defined therein and handle means for hand-carrying the carrier in use, said upstanding panel being a unitary, shock-absorbing, resilient, flexible shaped thermoplastic molded foam member having an outwardly projecting three-dimensional graphical display configuration portion defined in said outwardly facing major surface, said thermoplastic foam member having an intimately adhered knitted fabric covering on said outwardly facing major surface, said foam member having a peripheral edge portion and being directly interconnected into said carrier body along said peripheral edge portion.

4. A carrier as defined in claim 3, wherein said knitted fabric comprises nylon and polyethylene.

5. A carrier as defined in claim 3 wherein said knitted fabric is intimately adhered to said foam layer by means of an adhesive composition.

* * * * *